US006405501B1

(12) United States Patent
Cerrato

(10) Patent No.: US 6,405,501 B1
(45) Date of Patent: Jun. 18, 2002

(54) SHIMLESS-SHIM JAMB MOUNTING ASSEMBLY

(76) Inventor: Jaime M. Cerrato, 67 Reynolds Ave., Parsippany, NJ (US) 07054

( * ) Notice: Subject to any disclaimer, the term of this patent is extended or adjusted under 35 U.S.C. 154(b) by 0 days.

(21) Appl. No.: 09/564,553

(22) Filed: May 4, 2000

(51) Int. Cl.[7] ..... E06B 1/04

(52) U.S. Cl. ..... 52/217; 52/127.2; 52/745.15; 49/505; 248/351; 248/544

(58) Field of Search ..... 52/213–217, 364, 52/365, 211, 212, 127.2, 745.15; 49/505, 467, 468

(56) References Cited

U.S. PATENT DOCUMENTS

| | | | | |
|---|---|---|---|---|
| 4,829,727 A | * | 5/1989 | Kuzara et al. | 52/127.2 |
| 5,655,343 A | * | 8/1997 | Seals | 52/217 |
| 5,881,510 A | * | 3/1999 | Ole | 52/217 |
| 6,178,717 B1 | * | 1/2001 | Loop | 52/714 |

* cited by examiner

*Primary Examiner*—Carl D. Friedman
*Assistant Examiner*—Yvonne M. Horton
(74) *Attorney, Agent, or Firm*—Alfred C. Hill

(57) ABSTRACT

The shimless-shim employed with an edge member of a rough opening in a structure helps true up a jamb in the rough opening comprising a first member disposed parallel to the edge member having a length equal to the width of the edge member and the thickness of the wall boards attached to both edges of the edge member; a pair of a second members attached to the first member in a perpendicular relationship thereto, the pair of second members being disposed in a spaced relationship with respect to each other to enable each of the pair of second members to be disposed between a different one of the edges of the edge member and an adjacent one of the wall boards, the pair of the second members being adjustable in and out to assist in truing up the jamb in the rough opening; a first fastener is associated with the first member to enable fastening the jamb thereto; and a second fastener is associated with each of the pair of the second members and the edge member to secure the pair of second members to the edge member after the jamb has been trued up in the rough opening.

20 Claims, 3 Drawing Sheets

SHIMLESS-SHIM JAMB MOUNTING ASSEMBLY

BACKGROUND OF THE INVENTION

The present invention relates to jamb mounting assemblies and more particularly to an improved jamb mounting assembly which is shimless-shim in nature.

In the construction of doorways, windows, and other structural openings, it is common place to provide a jamb about the inner edge thereof for finishing the rough edge of the structural opening and for supporting a window or door there within. Although metal and other types of pre-manufactured jambs are used, the predominant jamb material is wood.

A great deal of cost in erecting or renovating a structure is, of course, attributable to labor. A substantial portion of labor is expended in the finishing or a "trimming" of the structure. This includes the preparation and installation of various molding, doors and windows and the aligning and fastening of the jambs which line the openings in the structure. In order to simplify the installation of jambs in structure openings, it is has become common for a jamb assembly to be prepackaged in one of several standard sizes. Such assemblies commonly include jambs for the opening and molding which frames the outline of the opening and sometimes include framing members for the opening. However, the procedure for installing the jambs has not changed substantially over the years.

Typically, a structural opening is bounded by framing members, such as wooden studs. The installation of such studs ordinarily takes place early in the construction process and without time-consuming measuring, plumbing and truing operations. Hence, the perimeter of the rough structural opening usually does not comprise a true rectangle, and the sides of the opening are commonly not plumb. Further, the dimensions of the openings vary substantially so that is it rarely possible to attach jambs directly to the framing and provide a serviceable opening which will precisely receive a door or other closure.

In order to produce a properly sized, squared opening, such as a doorway, it is, therefore, necessary to dispose each members of the jamb in a proper position with respect to one another, regardless of their relationship to the surrounding framing or rough structural members. The gaps between the framing members and the jamb are then filled with wooden shims. The shims are usually tapered wooden members, such a wooden shingles, to afford a measure of a "adjustability". Individual shims, and combinations thereof, are painstakingly fitted between the jambs and framing until it is found that the jamb is plumb, and at a predetermined distance from the opposing jamb member. Then nails are driven through the jamb and the shims, into the supporting framing. If all goes well, the nailing does not substantially disturb the placement of the jamb. At this point, protruding pieces of the wedge, if any, must be cut off flush with the edge of the jamb. Finally, the surrounding molding must be fitted and nailed to the periphery of the opening.

As can be seen, the prior arrangement for truing a jamb is rather cumbersome and the nailing process can upset the placement of the jamb and move the jamb out of the true.

SUMMARY OF THE INVENTION

An object of the present invention is to provide a jamb mounting assembly that does not require the use of wooden shims.

Another object of the present invention is to provide a shimless-shim jamb mounting assembly that reduces the time of truing the jamb in the rough opening and maintains the trueness when the shimless-shim member is fastened in place once the jamb is trued up.

A feature of the present invention is the provision of a shimless-shim employed with an edge member of a rough opening in a structure for truing up a jamb in the rough opening comprising; a first member disposed parallel to the edge member having a length equal to the width of the edge member and the thickness of wall board attached to both edges of the edge member; a pair of second members attached to the first member in a perpendicular relationship thereto, the pair of second members being disposed in a spaced relationship with respect to each other to enable each of the pair of second members to be disposed between a different one of the edges of the edge member and an adjacent one of wall boards, the pair of second members adjustable in and out to assist in truing up the jamb in the rough opening; a first means associated with the first member to enable fastening the jamb thereto; and second means associated with each of the pair of second members and the edge member to secure the pair of second members to the edge member after the jamb has been trued up in the rough opening.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENT

Figure 1:
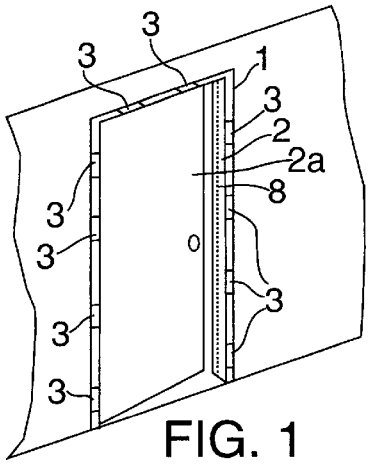
FIG. 1 is a perspective view of a rough opening in a building structure having a door and jamb assembly placed in the rough opening using the shimless-shim of the present invention to true up the jamb in this rough opening.

Referring to FIG. 1 there is illustrated therein a wall of a building which has a rough opening 1 into which it is desired to place a door. Of course, it would be possible to use the shimless-shim of the present invention in the truing of a window in a opening of a building.

The truing of the jamb 2 of the door 2*a* is accomplished in the present invention by employing a number of the shimless-shim 3 to assure that the jamb 2 of the door is true and plumb in the rough opening 1.

Figure 2:
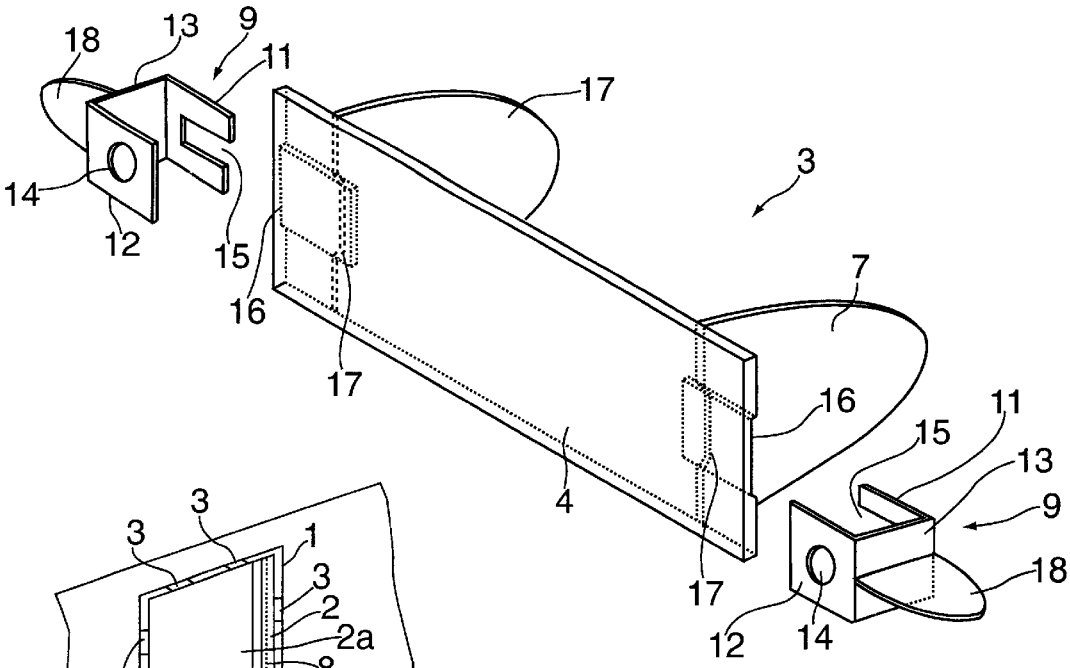
FIG. 2 is an exploded, perspective view of the shimless-shim in accordance with the principles of the present invention.
Figure 3:
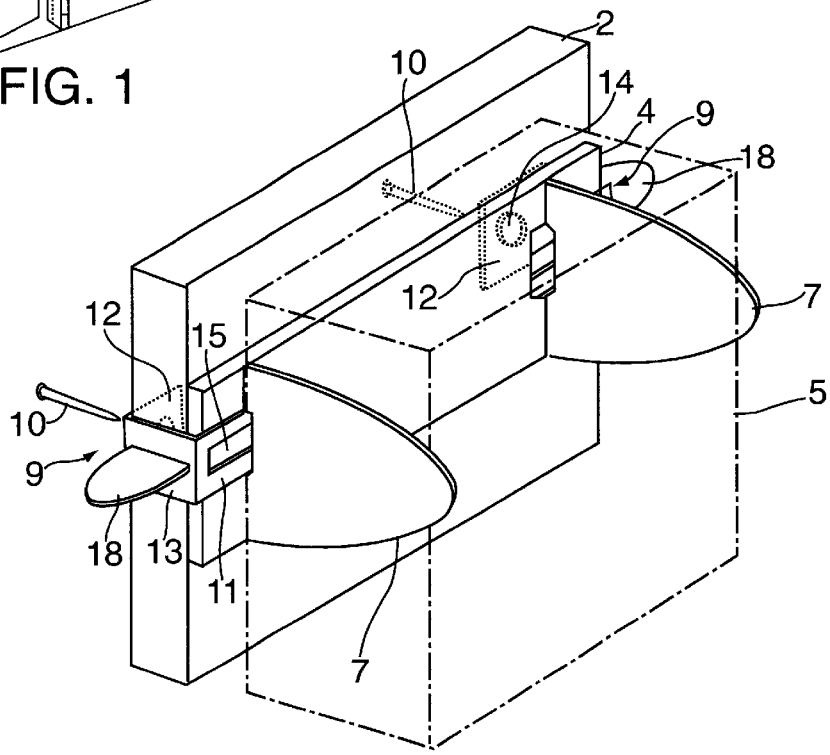
FIG. 3 a perspective view of the shimless-shim of FIG. 1 as it is employed with respect to the jamb and the edge member of a rough opening in a structure.

Referring to FIGS. 2 and 3, the shimless-shim 3 is illustrated as including a first member 4 disposed parallel to an edge member 5 in the form of a stud of the framing of the structure. The first member 4 has a length equal to the width of the edge member 5 and the thickness of the wall boards 6 attached to both edges of edge member 5 as best illustrated in FIGS. 4–8.

The shimless-shim 3 further includes a pair of second member or fins 7. The members 7 are disposed in a spaced relationship with respect to each other to enable each of the members 7 to be disposed between a different edge of the edge member 5 and an adjacent one of the wall boards 6 as best seen in FIGS. 4–8. The member 4 and the members 7 are adjustable in and out to assist in truing up the jamb 2 in the rough opening including the edge member 5 as illustrated in FIG. 7.

A first means associated with the member 4 is provided to enable fastening the jamb 2 to a member 4.

The first means includes a pair of removable clamps 9. Each of the clamps 9 engage a different end of member 4 and a different edge portion of the jamb 2 to hold the jamb 2 against member 4. A fastening means such as a trimhead screw 10 extends through each of the clamps 9, jamb 2 and member 4 to hold jamb 2 and member 4 together after removing the pair of clamps 9.

Each of the pair of clamps 9 includes a U-shaped member having a pair of spaced legs 11 and 12 and a connecting member 13 connecting the legs 11 and 12 together at one end thereof. One of the pair of spaced legs, such as leg 12, has an aperture 14 therein and the other of the pair of the pair of spaced legs 11 has a longitudinal slot therein extending from a point spaced from connecting member 13 to the end of leg 11. When clamps 9 are placed in position to clamp jamb 2 to member 4, leg 12 is adjacent jamb 2 and leg 11 is adjacent member 4.

A notch portion 16 is provided adjacent each end of member 4 to provide a guide for each of the clamps 9 for easier application of the clamps 9 to facilitate the clamping of jamb 2 to member 4. Since the clamps 9 extend beyond the members 7, a notch 17 is provided in each of members 7 to enable receipt of the clamp 9 to its fullest extent in notch 16.

Each of the clamps 9 include a member 18 secured to connecting member 13 in a perpendicular relationship thereto to assist in removing the clamps 9 from the jamb 2 and the first member 4 after the fastening means 10 has fastened the jamb 2 and member 4 together. Clamps 9 can be made of plastic as well as other disposable material that can perform the same function described herein.

Figure 6:
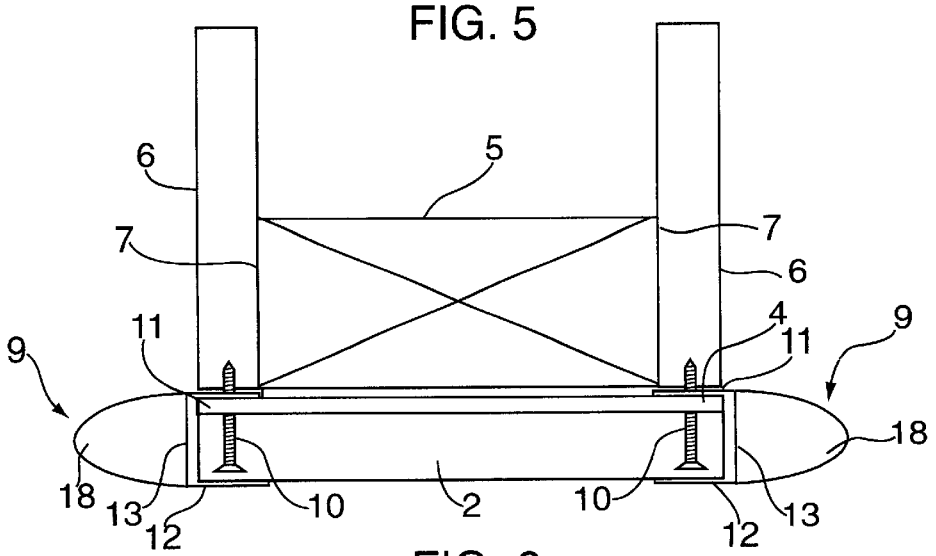
Figure 7:
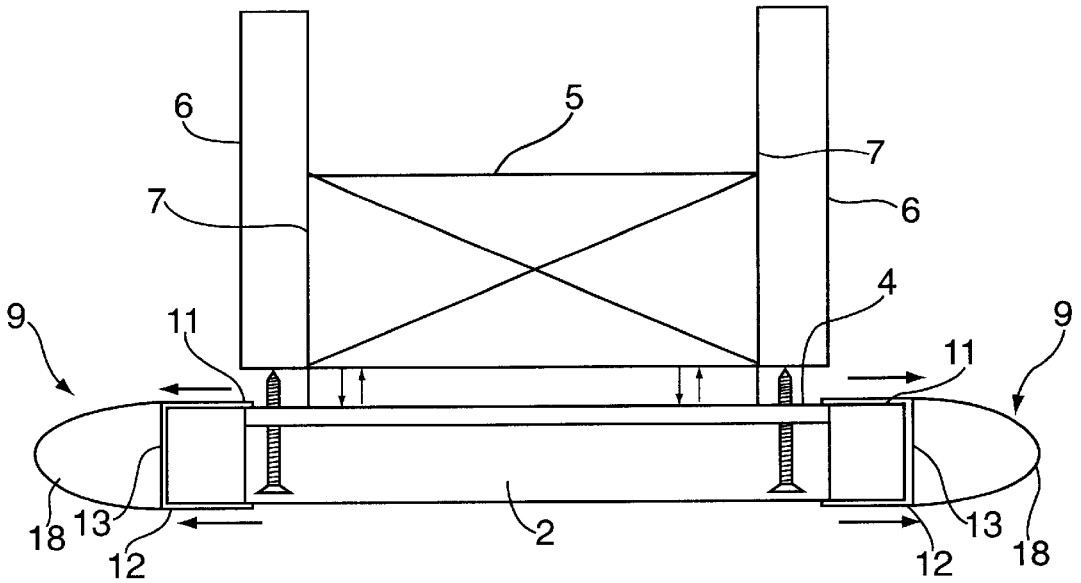
Figure 8:
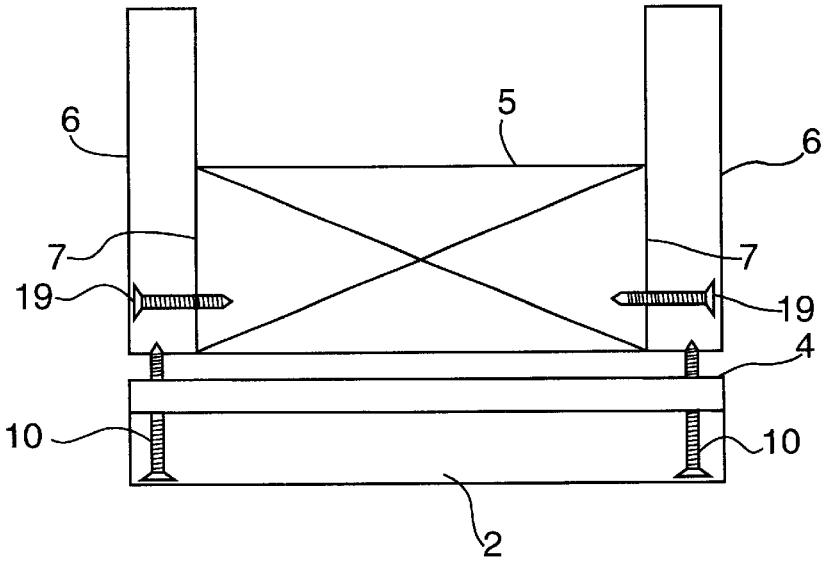

The fastening means in the form of screw 10 extends through the aperture 14 in leg 12, into the jamb 2, the first member 4 and through the longitudinal slot 15 into the wallboard 6, as shown in FIG. 6. Since screws 10 are countersunk, the clamps 9 may be removed after fastening the jamb 2 and member 4 together, since the slot 15 enables by passing screw 10.

Figure 4:
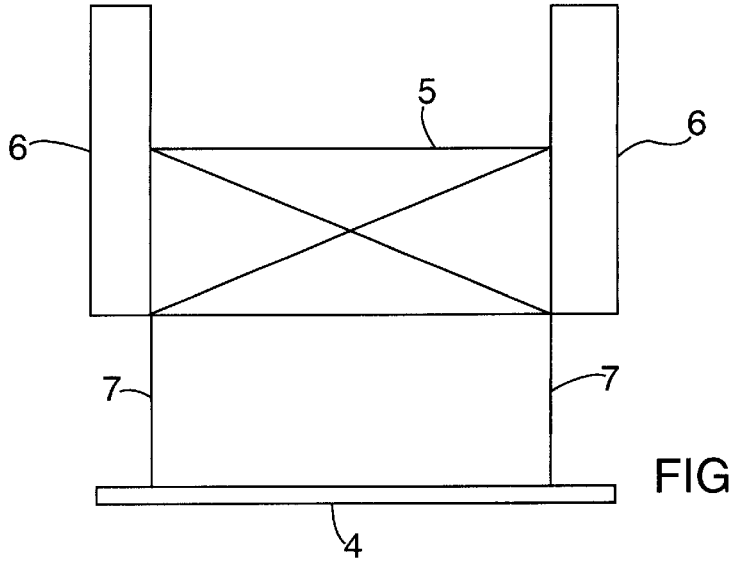
FIG. 4–8 are plan views of the shimless-shim in relationship with a rough opening in a structure illustrating the steps in employing the shimless-shim in accordance with the principles of the present invention.
Figure 5:
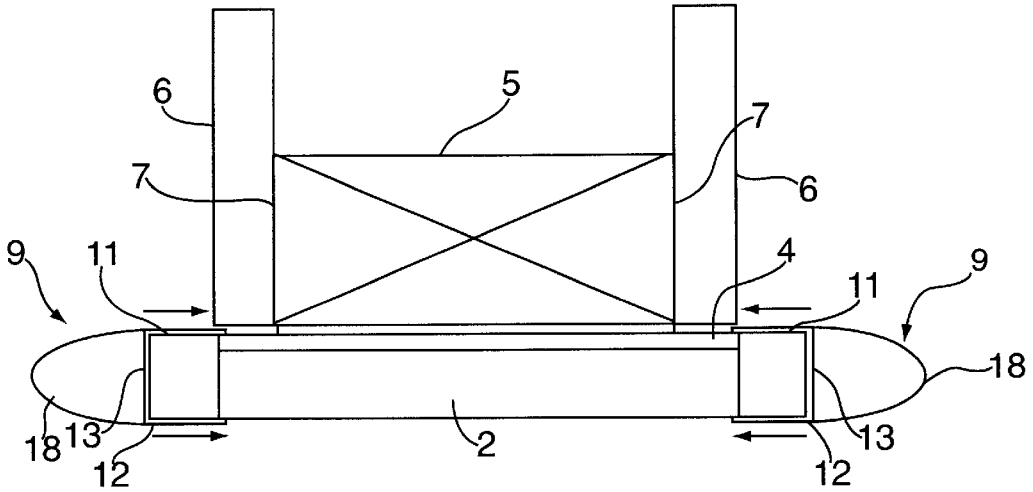

Referring to FIGS. 4–8, an explanation of how the shimless-shim 3 of the present invention is employed to true up the jamb 2 in the rough opening 1 will be presented. The first step is to insert the members 7 between the drywalls 6 and the adjacent edge of the edge member or stud 5 of the rough opening 1. Pressing or tapping the shim all the way in with a hammer is advantageous. This is shown in FIGS. 4 and 5.

The next step is to place the jamb 2 against the member 4 and to slide the clamps 9 into place as shown in FIG. 5.

The third step is to drive a trimhead screw 10 through the alignment hole or aperture 14 of clamp 9. And then countersinking the screws 10 into the jamb 2 as illustrated in FIG. 6.

The next step is to remove the clamps 9 and adjust the jamb 2 and the shimless-shim 3 inward and outward to achieve a truing up of jam 2 in the rough opening 1 provided by the end member 5. This is shown in FIG. 7. Prior to final securing, wall board holds shimless-shim 3 in place.

Once the adjustment for truing the jamb 2 is complete, a drywall screw 19 is driven through the drywall 6 into the adjacent member 7 and the adjacent edge of end member 5 in an area that is covered by the casing to thereby secure the adjustment previously made to true up frame 8. This is shown is FIG. 8.

The screw 19 provides the second means to secure the pair of members 7 with regard to the edge member 5 after the jamb 2 has been trued up in the rough opening.

While I have described above the principles of my invention in connection with specific apparatus, it is to be clearly understood that this description is made only by way of example and not as a limitation to the scope of my invention as set forth in the objects thereof and in the accompanying claims.

I claim:

1. A shimless-shim employed with an edge member of a rough opening in a structure for truing up a jamb in said rough opening comprising:

a first member adapted to be disposed parallel to said edge member having a length equal to the width of said edge member and the thickness of wall boards adapted to be attached to both edges of said edge member;

a pair of second members attached to said first member in a perpendicular relationship thereto, said pair of second members being disposed in a spaced relationship with respect to each other to enable each of said pair of second members to be disposed between a different one of said edges of said edge member and an adjacent one of said wall boards, said pair of second members being adjustable in and out to assist in truing up said jamb in said rough opening;

first means associated with said first member adapted to fasten said jamb to said first member; and second means associated with each of said pair of second members and said edge member to secure said pair of second members to said edge member after said jamb has been trued up in said rough opening.

2. A shimless-shim according to claim 1, wherein said first means includes a pair of removable clamps, each of said pair of removable clamps engaging a different end of said first member and a different edge portion of said jamb, said pair of removable clamps adapted to hold said jamb against said first member, and first fastening means extending through each of said pair of removable clamps, said jamb and said first member to hold said jamb and said first member together after removing said pair of removable clamps.

3. A shimless-shim according to claim 2, wherein each of said pair of removable clamps includes a U-shaped member having a pair of spaced legs and a connecting member connecting said pair of spaced legs at one end thereof, one of said pair of spaced legs adjacent said jamb containing an aperture therein and the other of said pair of spaced legs adjacent said first member has a longitudinal slot therein extending from a point spaced from said connecting member to the end thereof.

4. A shimless-shim according to claim 3, wherein each of said pair of removable clamps further includes a third member secured to said connecting member in a perpendicular relationship thereto to assist in removing each of said pair of removable clamps from said jamb and said first member after said first fastening means has fastened said jamb and said first member together.

5. A shimless-shim according to claim 4, wherein each of said U-shaped members and each of said third members are plastic members.

6. A shimless-shim according to claim 3, wherein each of said first fastening means extends through said aperture of said one of said pair of spaced legs, said jamb, said first member and said longitudinal slot of said other of said pair of spaced legs, each of said first fastening means being countersunk in said jamb through said aperture in said one of said pair of spaced legs to enable removal of each of said pair of removable clamps, said longitudinal slot in said other of said pair of spaced legs also enabling said removal of each of said pair of removable clamps.

7. A shimless-shim according to claim 6, wherein each of said pair of removable clamps further includes a third member secured to said connecting member in a perpendicular relationship thereto to assist in removing each of said removable clamps from said jamb and said first member after said first fastening means has fastened said jamb and said first member together.

8. A shimless-shim according to claim 7, further including a first notched portion adjacent each end of said first member to provide a guide for each of said pair of removable clamps.

9. A shimless-shim according to claim 8, wherein each of said first notched portion extends beyond an adjacent one of said pair of second members, and each of said pair of second members includes a second notched portion adjacent said first member to receive an associated one of said pair of removable clamps.

10. A shimless-shim according to claim 6, further including a first notched portion adjacent each end of said first member to provide a guide for each of said pair of removable clamps.

11. A shimless-shim according to claim 10, wherein each of said first notched portion extends beyond an adjacent one of said pair of second members, and each of said pair of second members includes a second notched portion adjacent said first member to receive an associated one of said pair of removable clamps.

12. A shimless-shim according to claim 9, wherein said second means includes second fastening means driven through an associated one of said wall board and an associated one of said pair of second members into an adjacent one of said edges of said edge member.

13. A shimless-shim according to claim 1, wherein said first means includes a pair of removable U-shaped members having a pair of spaced legs and a connecting member connecting said pair of spaced legs at one end thereof, each of said pair of U-shaped members engaging a different end of said first member and a different edge portion of said jamb, one of said pair of spaced legs having an aperture therein, said one of said pair of spaced legs bearing against said jamb and the other of said pair of spaced legs having a longitudinal slot therein extending from a point spaced from said connecting member to the end thereof, said other of said pair of spaced legs bearing against a surface of said first member spaced from said jamb, and a pair of first fasteners each extending through a different one of said apertures, said jamb, said first member and said longitudinal slot join said jamb to said first member when said pair of removable U-shaped members are removed.

14. A shimless-shim according to claim 13, wherein each of said pair of removable U-shaped members further includes a third member secured to and in a perpendicular relationship with said connecting member to assist in removing each of said pair of removable U-shaped members from said jamb and said first member after said pair of first fasteners have fastened said jamb and said first member together.

15. A shimless-shim according to claim 14, further including a first notched portion adjacent each end of said first member to provide a guide for each of said pair of removal U-shaped members.

16. A shimless-shim according to claim 15, wherein each of said first notched portion extends beyond an adjacent one of said pair dice of second members, and each of said pair of second members includes a second notched portion adjacent said first member to recive an associated one of said pair of removable U-shaped members.

17. A shimless-shim according to claim 13, further including a first notched portion adjacent each end of said first member to provide a guide for each of said pair of removable U-shaped members.

18. A shimless-shim according to claim 17, wherein each of said first notched portion extends beyond an adjacent one of said pair of second members, and each of said pair of second members includes a second notched portion adjacent said first member to receive an associated one of said pair of removable U-shaped members.

19. A shimless-shim according to claim 14, wherein each of said pair of removable U-shaped members and each of said third members are plastic members.

20. A shimless-shim according to claim 16, wherein said second means includes a pair of second fasteners driven through an associated one of said wall boards and an associated one of said pair of second members into an adjacent one of said edges of said edge member.

* * * * *